US005966067A

United States Patent [19]

Murakami et al.

[11] Patent Number: 5,966,067

[45] Date of Patent: Oct. 12, 1999

[54] THICK FILM RESISTOR AND THE MANUFACTURING METHOD THEREOF

[75] Inventors: Mamoru Murakami, Chadds Ford, Pa.; Hisashi Matsuno; Keiichiro Hayakwa, both of Tochigi-ken, Japan

[73] Assignee: E. I. du Pont de Nemours and Company, Wilmington, Del.

[21] Appl. No.: 09/211,233

[22] Filed: Dec. 14, 1998

[30] Foreign Application Priority Data

Dec. 26, 1997 [JP] Japan ..... 9-366680

[51] Int. Cl.[6] ..... H01C 1/012

[52] U.S. Cl. ..... 338/309; 338/307; 338/308; 338/313; 338/327

[58] Field of Search ..... 338/307, 308, 338/309, 313, 327, 328

[56] References Cited

U.S. PATENT DOCUMENTS 5,258,738 11/1993 Schat ..... 338/332
5,294,910 3/1994 Tani et al. ..... 338/306
5,379,017 1/1995 Katsuno ..... 338/332

FOREIGN PATENT DOCUMENTS 3-52202 3/1991 Japan .
5-53284 8/1993 Japan .

*Primary Examiner*—Lincoln Donovan
*Assistant Examiner*—Richard Lee

[57] ABSTRACT

A thick film resistor assembly comprising: (a) an insulation substrate, (b) a resistor layer being formed on surface of the insulation substrate, (c) a pair of conductor pads comprising a first Ag conductor layer comprising Ag powder and palladium or platinum or mixtures thereof, disposed on the insulation substrate with predetermined spaces from the resistor layer to sandwich the resistor layer in a direction of its conductive resistance path; and (d) a second Ag conductor layer comprising a Ag conductor composition devoid palladium or platinum or mixtures thereof, disposed over the resistor layer and conductor pads at their respective edges to connect electrically the resistor layer to the conductor pads forming a conductive resistance path.

3 Claims, 1 Drawing Sheet

THICK FILM RESISTOR AND THE MANUFACTURING METHOD THEREOF

FIELD OF THE INVENTION

The present invention relates to a thick film resistor which employs thick film technology in which a resistor paste is printed and fired between conductor pads which are formed by printing and firing the conductor paste on an insulation substrate such as the ceramic substrate. The present invention also relates to a manufacturing method of the thick film resistor. More particularly, it relates to a thick film resistor, such as the chip resistor, which can be used in any size and easily reduces changes in resistance values caused by the environmental change or a manufacturing process, and is provided with the characteristics of high accuracy, high reliability, and stability. It also relates to its manufacturing method.

BACKGROUND OF THE INVENTION

In the manufacturing of thick film resistors, the firing temperature and firing conditions are determined by the conductor material employed, for example, noble metal or base metal materials, and their melting points; moreover, various resistors are used for the desired resistance ranges and the firing condition is constrained also by their resistor compositions. Recently, various improvements are made on these thick film resistors and their manufacturing methods.

For instance, as described in Japanese Kokai Patent Hei 3 (1991)-52202, the following method is known: After the resistor paste, such as $RuO_2$ series and $Pb_2Ru_2O_6$ series, is printed and dried on the substrate, it is fired at 700–1000° C. in the oxidizing atmosphere; and after the conductor paste comprising Ag alone or a mixture of Ag with one or more selected from a group consisting of Au, Pd and Pt being dispersed in the vehicle, such as Ag-Pd series and Ag-Pt series for low temperature firing, which contains Ag as the main component is coated (printed) and dried in a predetermined position with respect to the resistor layer formed on the substrate to partially overlap the fired resistor layer, it is fired at temperature in the range of 500–700° C. in the same oxidizing atmosphere to manufacture a chip resistor. In particular, it suppresses diffusion of the Ag component toward the resistor film by lowering the firing temperature of the Ag conductor paste from the resistor paste firing temperature.

Japanese Kokoku Patent Hei 5 (1993)-53284 describes a manufacturing method in which, for example, a resistor paste comprising $RuO_2$ is screen-printed and fired in the oxidizing atmosphere to form a resistor film; a paste; which contains as the conducting component a base metal that can be fired in the temperature range lower than the firing temperature of the resistor film, for instance at 500–600° C., is used to print so as to partially overlap the resistor film edge, and fired in the nitrogen atmosphere to form the conductor pads (terminations). In order to form the base metal conductor, firing must be done in the reducing or inert atmosphere. The conductor oxidation and degradation are prevented by firing at the temperature lower than the firing temperature of the resistor film. The conductor paste comprising the base metal such as Cu must be fired in the reducing atmosphere; the resistor paste fired in the same reducing atmosphere is not only expensive but the temperature coefficient resistance (TCR) of the resistor obtained is poor and the resistance value range is extremely narrow. Therefore, the fact that both the conductor paste and resistor paste can be fired in the air not only simplifies the manufacturing method but also reduces the resistance value change over a wide range of resistance values and can give resistors which are excellent in resistance characteristics and also economically advantageous. Hence, the conductor paste with Ag as the main component can be used together with a resistor paste that can be fired in air.

In the manufacturing method of this conventional thick film resistor and the thick film resistor structure in which part of the conductor forms an overlapping joint with a resistor formed on the substrate on its both edges, it has never been sustained that performances originally required for such conductor pads, for instance, high strength of adhesion to the insulation substrate and sulfurization resistance are provided and uniform and accurate resistance characteristics over a wide resistance range, small resistance value changes caused by the environmental change or manufacturing process and reliability of the resistor are maintained; since there is apprehension on these points no commercialization has been attained.

Thus, it is desired that when the uniform and same resistance material is used, a thick film resistor is formed with desirable resistance characteristics of high accuracy even in different sizes and small resistance value changes as reliability and is provided with conductor pads of well-balanced high adhesion strength and sulfurization resistance, and the manufacturing method thereof is provided. Consequently, the objective of the present invention is that, in the thick film resistor and the manufacturing method thereof, in which the Ag series thick film conductor paste as the conductor material and the resistor paste which can be fired in the oxidizing atmosphere are used, and each of them is printed and fired on the insulation substrate so as to form a resistor (resistor film) between the conductors, the above-mentioned problems of the current technology are solved, and a thick film resistor of high performance and high reliability, and its manufacturing method are presented.

In view of the above-mentioned situation, as a result of zealous investigation in order to solve the above-mentioned problems the present inventors found the following: A thick film resistor and the manufacturing method thereof in which (1) a resistor layer is formed on surface of a insulation substrate, (2) a pair of conductor pads of Ag conductor composition comprising palladium and/or platinum is disposed with predetermined spaces from said resistor layer to sandwich said resistor layer in a direction of its conductive resistance path on the surface of insulation substrate, and (3) Ag conductor layer of Ag conductor composition without palladium and platinum is disposed over both said resistor layer and conductor pads at their respective edges to connect electrically said resistor layer to said conductor pads to form the conductive resistance path gave small resistance value changes, a small TCR in any sizes of resistors and improved the resistance value yield and, furthermore, could give high adhesion strength between the insulation substrate and conductor pads, and high sulfurization resistance to solve the above-mentioned problems. Thus the present invention was achieved.

SUMMARY OF THE INVENTION

The present invention is based on the above-mentioned information and provides the following "Thick Film Resistor" and "Manufacturing Method for Thick Film Resistor".

1. A thick film resistor assembly comprising:
   (a) an insulation substrate,
   (b) a resistor layer being formed on surface of the insulation substrate, (c) a pair of conductor pads comprising a first Ag conductor layer comprising Ag powder and palladium or platinum or mixtures thereof, disposed on the insulation substrate with predetermined spaces from the resistor layer to sandwich the resistor layer in a direction of its conductive resistance path; and (d) a second Ag conductor layer comprising a Ag conductor composition devoid palladium or platinum or mixtures thereof, disposed over the resistor layer and conductor pads at their respective edges to connect electrically the resistor layer to the conductor pads forming a conductive resistance path.

2. The thick film resistor of claim 1 wherein the assembly is covered by a protective layer in which glass is the main component.

3. The thick film resistor of claim 1 in which the resistor layer and the conductor pads are formed on the surface of the insulation substrate by co-firing in the air at the temperature of 800–900° C.

4. A manufacturing method of a thick film resistor assembly comprising the following steps:

(a) applying and drying a resistor paste onto the surface of the insulation substrate to make a resistor layer;

(b) applying and drying a first Ag conductor layer comprising Ag powder and palladium or platinum or mixtures thereof disposed on the same surface of the insulation substrate as the resistor layer wherein the conductor pads are arranged with predetermined spaces from the resistor layer to sandwich the resistor layer in a direction of its conductive resistance path;

(c) co-firing the resistor layer and conductor pads in air, and (d) applying and firing a second Ag conductor layer devoid palladium or platinum or mixtures thereof wherein the second Ag conductor layer is disposed over the resistor layer and conductor pads by overlapping the edges of the resistor layer and conductor pads.

5. The manufacturing method of claim 4 wherein the first Ag conductor layer comprises 0.5–20 wt % palladium or platinum or mixtures thereof.

6. The manufacturing method of claim 4 in which the resistor layer and the conductor pads formed on the surface of the insulation substrate are co-fired in the air at a temperature of 800–900° C.

7. The manufacturing method of claim 4 in which the firing temperature of Ag conductor layer without palladium and platinum is 550–650° C.

8. The manufacturing method of claim 4 further comprising applying a lead glass to cover the assembly and firing the glass protective layer in the air at the temperature of 550–650° C.

1 Ceramic substrate

2 Resistor film

3,4 Surface conductor pad

5,6 Reverse side conductor pads

7 External electrode

8 Connecting Ag conductor film

9 Glass coating (protective layer)

Figure 1:
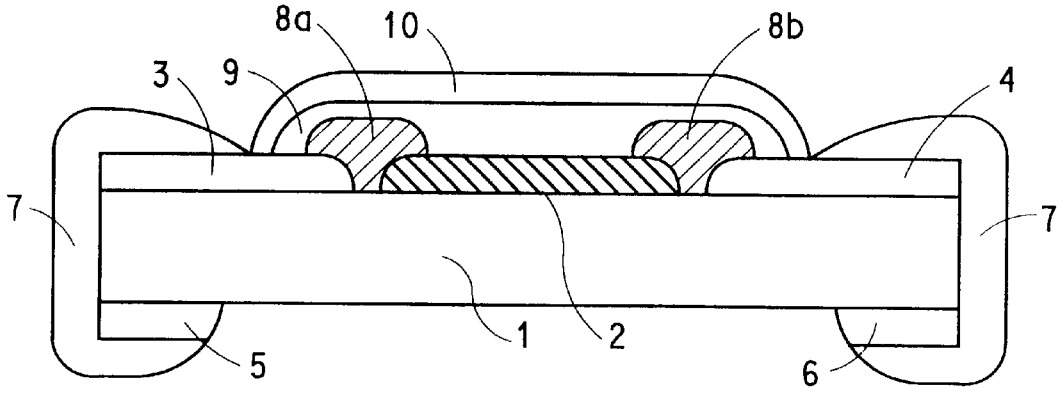
FIG. 1 is a cross-section of the thick film resistor in the example of embodiment of the present invention.

10 Resin coating or black glass coating (protective layer)

DETAILED DESCRIPTION OF THE INVENTION

The present invention is described in detail in the following.

A. Resistor paste

The resistor paste employed in the present invention may be those usually used as the thick film paste; employed is a paste having a suitable viscosity in which ruthenium oxide and/or pyrochlore type ruthenium oxide powder and the glass powder as inorganic binders are dispersed and mixed together in the vehicle which is a mixture of a resin and suitable solvent. The solids component of a typical resistor paste composition is in the range of 60–90 wt % and the remaining is the vehicle. As aforementioned, the resistance value of the resistor film (layer) varies according to the type of conducting component and particle size; generally, the resistance value decreases with increasing compounding ratio of the conductor component in the solids component, and the resistance value increases with decreasing compounding ratio of the conductor component. Generally, the conductor component is 10–50 wt % of the total solids component. Since most of the thick film paste is applied to the substrate by screen-printing, it must have the suitable viscosity that can pass through the screen easily. Used for the most commonly used organic vehicle may be ethylcellulose dissolved in a mixture of P-terpineol and other solvents. The amount and type of vehicle employed are determined mainly by the desired final viscosity and printed film thickness. These resistor paste compositions are suitably prepared by the use of the three roll mixer.

B. Ag series thick film conductor paste

As described in the aforementioned item (1), the metal conductor component of the first Ag conductor paste, which is a Ag series thick film conductor paste that forms the conductor pads of the thick film resistor of the present invention and is a mixture of Ag powder with Pd (palladium) and/or Pt (platinum). Pd or Pt is to prevent migration which becomes a problem when Ag is used for conductor paste. On the other hand, the metal conductor component of the Ag series thick film conductor paste for forming the second Ag conductor layer being arranged over edges of the resistor film and conductor pads formed on the substrate, which confront each other, contains at least Ag powder but does not need to contain Pd and Pt. As long as the particle size of these conductor powders is suitable for dispersing easily in the vehicle and printing on the substrate, it is not particularly important. However, it is 0.1–10 $\mu$m, preferably 0.3–3 $\mu$m. Thus, the thick film conductor paste containing at least Ag powder as the main component is a paste in which the metal conductor component, such as Ag powder, and the inorganic binders are dispersed in the vehicle; usually it is printed by the screenprinting method or its modification to make conductor films on the substrate or over the above-mentioned resistor film and conductor pads. Moreover, because of a contribution to sulfurization resistance, in the case of first Ag thick film conductor paste for conductor pads, based on the total weight of inorganic solids Ag powder is 70–98 wt %, noble metal powders other than Ag are 0.5–20 wt % and the inorganic binders are 0.5–2 wt %. As to the second Ag series thick film conductor paste for the aforementioned Ag conductor layer, based on the total weight of inorganic solids it is the inorganic solids comprising 80–95 wt % of Ag powder and 0.5–20 wt % of inorganic binders, which are dispersed in the vehicle. Usually, in order to obtain a good film, the thick film conductor paste compositions contains 60–90 wt % of inorganic solids and 40–10 wt % of vehicle. There is no particular limitation to the glass powder of inorganic binders; a broad type of glass containing commonly-used glass-forming and modifying components can be used. For instance, alumino borosilicate, lead silicate such as lead borosilicate and lead silicate itself, and bismuth silicate can be used. For the organic vehicle generally used, ethylcellulose dissolved in a mixture of P-terpineol and other solvents can be used. The amount and type of the vehicle used can be determined mainly by the desired final viscosity and the printed film thickness. These thick film conducting pastes are suitably prepared by the use of the three roll mixer.

C. Insulation substrate

As long as the substrate used in the present invention is a substrate based on the commonly-used well known ceramics there is no particular limitation. The examples of ceramic substrate are alumina, beryllia, hafnia, nitrides, carbides and glass ceramics, aluminum nitride, silicon carbide, silicon nitride and boron nitride. The suitable substrate in the present invention is the alumina substrate comprising 96% $Al_2O_3$.

D. Structure of thick film resistor

Figure 2:
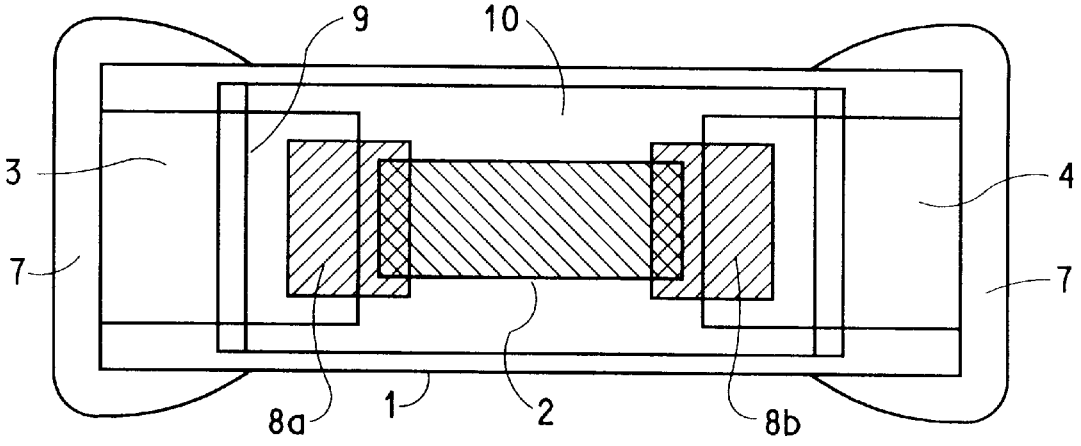
FIG. 2 is a top view of the thick film resistor in the example of embodiment of the present invention. The figures are marked with the following references.

FIGS. 1 and 2 show one example of the thick film resistor structure obtained from the present invention. In the drawings, resistor layer (film) 2 is formed on ceramic substrate 1, and a pair of conductor pads 3, 4 are formed on both ends at a certain space. Resistor layer (film) 2 is allowed to have the film thickness of 7–11 μm after firing the above-mentioned resistor paste, and the first and second (surface) conductor pads 3 and 4 are allowed to have 8–12 μm of film thickness after firing the above-mentioned Ag-Pd (or Pt) series thick film conductor paste. There are reverse side conductor pads 5 and 6 which sandwich substrate 1 and are formed to face conductor pads 3 and 4. These reverse side conductor pads 5 and 6 are also made by printing and firing the thick film conductor paste which contains metal components such as Ag, Ag-Pd and Ag-Pt. In FIG. 1, 7 is an external electrode which is arranged so as to partially cover reverse side conductor pad 5 facing surface conductor pad 3 and reverse side conductor pad 6 facing surface conductor pad 4 to achieve electrical connection between front and reverse conductor pads. The thick film conductor paste, which contains the aforementioned Ag but contains neither Pd nor Pt, is used to form Ag conductor layer (film) 8(*a*) and 8(*b*) which achieve electrical connections between resistor film 2 and the first or second (surface) conductor pads 3 or 4 by overlapping the edges of resistor film 2 and the first and second surface conductor pads 3 and 4, which confront each other. Moreover, glass coating 9 and resin coating or black colored glass coating 10 is disposed so as to cover at least the surfaces of resistor film 2 and connecting conductor layers (films) 8(*a*) and 8(*b*) for protection.

The thick film resistor and the manufacturing method thereof are described with the examples of embodiment and drawings in the following. Moreover, this description does not at all limit the content of the present invention. Moreover, unless stated otherwise all parts, % and ratios in the present specification including examples of embodiment are expressed in wt %.

EXAMPLES 1–12

The Ag (series thick film conductor) paste that forms the first and second conductor pads 3 and 4 comprises Ag powder 78 wt %, Pd powder 1 wt %, glass powder 1 wt % and organic vehicle 20 wt %; this glass powder has a composition of PbO 56 wt %, $SiO_2$ 28 wt $B_2O_3$ 8 wt %, $Al_2O_3$ 5 wt % and $TiO_2$ 3 wt %. Moreover, the Ag paste that forms the connecting Ag conductor layer (film) 8 comprises Ag powder 74 wt %, glass powder 6 wt % and organic vehicle 20 wt %, and the composition of this glass powder is PbO 49 wt %, $SiO_2$ 35 wt % $B_2O_3$ 3 wt %, ZnO 4 wt %, $TiO_2$ 5 wt % and $Na_2O$ 4 wt %. Furthermore, resistor paste A with the resistance value of ca. 200 ohms, resistor paste B with the resistance value of ca. 1K ohms, resistor paste C with the resistance value of ca. 10K ohms and resistor paste D with the resistance value of ca. 100K ohms were prepared, and the corresponding thick film resistors were made for trial by the combination shown in Table I with the manufacturing method for the thick film resistor of the present invention. Resistor paste A (ca. 200 ohms) comprises $RuO_2$ 21 wt %, glass powder 36 wt %, the generally-used oxide as TCR modifier, such as $Nb_2O_3$ 3 wt %, and organic vehicle 40 wt %; resistor paste B (ca. 1K ohms) comprises $RuO_2$ 17 wt %, glass powder 41 wt %, the generally-used oxide as TCR modifier, such as $Nb_2O_3$ 2 wt % and organic vehicle 40 wt %; resistor paste C (ca. 10 K ohms) comprises $RuO_2$ 8 wt %, $Pb_2Ru_2O_6$ powder 9 wt %, glass powder 41 wt %, the generally-used oxide as TCR modifier, such as $Nb_2O_3$ 2 wt % and organic vehicle 40 wt %; resistor paste D (ca. 100K ohms) comprises $RUO_2$ 3.5 wt %, $Pb_2RI_{12}O_6$ powder 12 wt %, glass powder 42 wt %, the generally-used oxide as TCR modifier, such as $Nb_2O_3$ 2.5 wt % and organic vehicle 40 wt %; and the glass powder composition contained in each of resistor pastes A, B, C and D is PbO 42 wt % $SiO_2$ 37 wt %, $B_2O_3$ 4 wt %, $Al_2O_3$ 5 wt %, ZnO 4 wt % and CaO 8 wt %.

Resistor pastes were printed on the alumina substrate 1 with the patterns of length 0.45 mm, width 0.3 mm, length 0.7 mm, width 0.5 mm and length 1.0 mm, width 0.8 mm with the ordinary screen printing followed by drying at 150° C. The resistor paste was used to screen-print the Ag paste on the same alumina substrate 1 at the space of 0.1–0.2 mm from the edge of the resistor film (determined by the thick film resistor size and targeted performance) followed by drying to form the first and second conductor pads 3 and 4. Dried resistor film 2 and the first and second dried conductor pads 3 and 4 were simultaneously fired in the air at the temperature of 850° C. (in this case, a heating cycle in which they were heated up to 850° C. at 35° C./min., maintained at 850° C. for 9–10 min. and cooled to room temperature at 30° C./min. was used). The conductor pads and resistor layer (film) are simultaneously fired (co-fired) in the oxidation atmosphere at 800–900° C., preferably at 830–870° C.

The Ag paste for the connecting Ag conductor layer which contains Ag powder but contains neither Pd nor Pt is printed with the ordinary screen printing on the edges of the fired resistor film 2, and the first and second conductor pads 3 and 4, which confront each other, so as to connect the aforementioned resistor film 2 to the first and second conductor pads 3 and 4. It was followed by drying at 150° C.

By further changing the lengths of the connecting Ag conductor layers (films) 8(*a*) and (*b*) of Ag conductor pastes the size of resistor layer (film) 2 of respective resistor pastes sandwiched by them was allowed to change to 0.3 mm×0.3 mm, 0.5 mm×0.5 mm and 0.8 mm×0.8 mm as shown in Table 1, each thick film resistor was made for trial and they were used for Examples 1–12. In this case, the dried joint Ag conductor layers (films) 8(*a*) and (*b*) were fired in the air at the temperature of 600° C.; and glass protective layer 9 in which the glass paste completely covered both connecting Ag conductor films 8(*a*) and (*b*), and resistor film 2 was further printed and dried with the ordinary screen printing method so that the dried film thickness would become 10–12

μm after firing, and fired in the air at 600° C. Afterward, resistor 2 covered by glass protective film 9 is subject to laser trimming and resin coating or black colored glass coating 10 is disposed. Thereafter, reverse side conductor pads 5 and 6 are formed and the thick film resistor is obtained by forming external electrode 7 by solder plating. Firing of this connecting Ag conductor film 8 and glass protective film 9 is suitably carried out in the range of 550–650° C.

Characteristics, sheet resistance values, resistance temperature coeffleients (TCR) and resistance noises (Quantech Noise 513 B) of the thick film resistors thus obtained were measured and the results are shown in Table 1. Moreover, as to TCR, low temperature coefficient (CTCR) is expressed by the rate of change of the resistance value in the temperature range of −55° C.–25° C. in terms of the value per degree C (ppm/°C.); high temperature coefficient (HTCR) is expressed by the rate of change of the resistance value in the temperature range of 25–125° C. in terms of the value per degree C (ppm/°C.). It is desirable that TCR be as close to 0 (zero) as possible. On the other hand, noise is measured with the generally-used Quan Tech noisemeter (condition of 0.1 W) smaller the value the more desirable.

COMPARATIVE EXAMPLES 13–24

Next, in order to compare characteristics of the present invention with those of the thick film resistors which have the structure of the thick film resistor by the present invention or which are made by the conventional manufacturing method (sic), concrete examples are used as the comparative examples for explanation. In order to form a pair of surface conductor pads of the thick film resistor with the aforementioned Ag conductor paste so as to be able to ignore the effect by the composition of each paste, screen printing was done followed by firing in the air at the temperature of 850° C. The aforementioned resistor pastes A (paste of 200 ohm resistance value), B (paste of 1K ohm resistance value), C (paste of 10K ohm resistance value) and D (paste of 100K ohm resistance value) were further printed with the usual screen printing in such a manner that the paste would stretch over each conductor pad and partially overlap the edges of the conductor pads that were already formed so that a pair of conductor pads could be directly connected electrically to the resistor layer, and also that each length and width of the distance between the conductor pads could become 0.8 mm×0.8 mm, 0.5 mm×0.5 mm and 0.3 mm×0.3 mm. It was followed by firing in the air at the temperature of 850° C. In the same way as the Examples, the glass paste was printed and dried with the usual screen printing method so that the resistor could be completely covered and the dried film thickness could become 10–12 μm after firing. It was followed by firing in the air at 600° C. The characteristics of thick film resistors obtained (Comparative Examples 13–24) were measured in the same way as the Examples. The results are shown in Table 2.

TABLE 1

| | Sheet Resistivity Value (Ω) | Resistor size (mm) | HTCR (ppm/° C.) | CTCR (ppm/° C.) | Noise (dB) (0.1 W) | Resistivity Value Accuracy (Standard deviation/ average × 100) (%) |
|---|---|---|---|---|---|---|
| Ex. 1 | 211 | 0.8 × 0.8 | 14 | 7 | −33 | 2.9 |
| Ex. 2 | 229 | 0.5 × 0.5 | 9 | 1 | −28 | 2.5 |
| Ex. 3 | 235 | 0.3 × 0.3 | 5 | −4 | −23 | 3.3 |
| Ex. 4 | 0.928K | 0.8 × 0.8 | 35 | 32 | −21 | 2.9 |
| Ex. 5 | 0.993K | 0.5 × 0.5 | 36 | 29 | −17 | 2.6 |
| Ex. 6 | 1.03K | 0.3 × 0.3 | 33 | 27 | −12 | 3.7 |
| Ex. 7 | 13.3K | 0.8 × 0.8 | 16 | −5 | −9 | 2.9 |
| Ex. 8 | 16.2K | 0.5 × 0.5 | 13 | −7 | −4 | 2.8 |
| Ex. 9 | 15.3K | 0.3 × 0.3 | 14 | −9 | 0 | 3.7 |
| Ex. 10 | 192K | 0.8 × 0.8 | −7 | −32 | −2 | 2.7 |
| Ex. 11 | 202K | 0.5 × 0.5 | −8 | −31 | 8 | 2.9 |
| Ex. 12 | 218K | 0.3 × 0.3 | −16 | −36 | Unmeasurable | 4.5 |

TABLE 2

| | Sheet Resistivity Value (Ω) | Resistor size (mm) | HTCR (ppm/° C.) | CTCR (ppm/° C.) | Noise (dB) (0.1 W) | Resistivity Value Accuracy (Standard deviation/ average × 100) (%) |
|---|---|---|---|---|---|---|
| Comp. Ex. 13 | 227 | 0.8 × 0.8 | 6 | −6 | −33 | 4.4 |
| Comp. Ex. 14 | 242 | 0.5 × 0.5 | 6 | −6 | −29 | 4.1 |
| Comp. Ex. 15 | 225 | 0.3 × 0.3 | 46 | 33 | −23 | 6.7 |
| Comp. Ex. 16 | 0.998K | 0.8 × 0.8 | 23 | 13 | −21 | 4.8 |
| Comp. Ex. 17 | 1.05K | 0.5 × 0.5 | 37 | 31 | −17 | 5.0 |
| Comp. Ex. 18 | 0.914K | 0.3 × 0.3 | 86 | 75 | −13 | 7.9 |
| Comp. Ex. 19 | 13.2K | 0.8 × 0.8 | 16 | −2 | −9 | 6.2 |
| Comp. Ex. 20 | 14.5K | 0.5 × 0.5 | 16 | −3 | −5 | 5.7 |
| Comp. Ex. 21 | 10.7K | 0.3 × 0.3 | 79 | 60 | 1 | 7.5 |
| Comp. Ex. 22 | 146K | 0.8 × 0.8 | 14 | −11 | −2 | 5.2 |
| Comp. Ex. 23 | 136K | 0.5 × 0.5 | 32 | 10 | 5 | 4.9 |
| Comp. Ex. 24 | 86.2K | 0.3 × 0.3 | 106 | 89 | 12 | 7.0 |

From Tables 1 and 2 it has become clear that, when compared under the same resistance value, according to the thick film resistor and the manufacturing method thereof of the present invention, as compared to the conventional one TCRs are roughly the same and the rate of change becomes extremely small despite the change in the resistor size. Furthermore, it was confirmed that the noise and resistance value accuracy of the thick film resistor obtained from the present invention showed the value approximately the same as the excellent characteristic obtainable from the current improved thick film resistor structure and manufacturing method, or that the change in resistance values was more improved and became small. Moreover, when post-firing adhesion strength between the insulation substrate and conductor pads was measured with the tensile test which is universally known in the technical field concerned, examples of embodiment gave more than 30N which is the sufficient adhesion strength required; also in sulfurization resistance, the phenomenon that noble metal components migrate by firing from the inside of the conductor pad to the glass coating that covers the upper part was not observed.

As explained above, according to the present invention, migration of noble metal components in conductor pads can be suppressed, the changes in resistance values and the temperature coefficient of resistance value can be reduced, hence resistance value yield can be improved; furthermore, high adhesion strength between the insulation substrate and conductor pads can be obtained, sulfurization resistance can be attained and thick film resistors which have reduced sizes, and are stable and highly reliable can be obtained.

We claim:

1. A thick film resistor assembly comprising:

(a) an insulation substrate, (b) a resistor layer being formed on surface of the insulation substrate, (c) a pair of conductor pads comprising a first Ag conductor layer comprising Ag powder and palladium or platinum or mixtures thereof, disposed on the insulation substrate with predetermined spaces from the resistor layer to sandwich the resistor layer in a direction of its conductive resistance path; and (d) a second Ag conductor layer comprising a Ag conductor composition devoid palladium or platinum or mixtures thereof, disposed over the resistor layer and conductor pads at their respective edges to connect electrically the resistor layer to the conductor pads forming a conductive resistance path.

2. The thick film resistor of claim 1 wherein the assembly is covered by a protective layer in which glass is the main component.

3. The thick film resistor of claim 1 in which the resistor layer and the conductor pads are formed on the surface of the insulation substrate by co-firing in the air at the temperature of 800–900° C.

* * * * *